US009683381B1

(12) United States Patent
Becker

(10) Patent No.: US 9,683,381 B1
(45) Date of Patent: Jun. 20, 2017

(54) TEMPLATE AND METHOD FOR MEASURING A RAFTER

(71) Applicant: Adam Becker, Overland Park, KS (US)

(72) Inventor: Adam Becker, Overland Park, KS (US)

( * ) Notice: Subject to any disclaimer, the term of this patent is extended or adjusted under 35 U.S.C. 154(b) by 0 days.

(21) Appl. No.: 15/294,308

(22) Filed: Oct. 14, 2016

(51) Int. Cl.
*E04G 21/00* (2006.01)
*E04G 21/18* (2006.01)
*B43L 7/10* (2006.01)

(52) U.S. Cl.
CPC ..... *E04G 21/00* (2013.01); *B43L 7/10* (2013.01); *E04G 21/1891* (2013.01)

(58) Field of Classification Search
CPC ..... E04G 21/1891; B43L 7/10
USPC ..... 33/417, 423
See application file for complete search history.

(56) References Cited

U.S. PATENT DOCUMENTS 1,616,820 A * 2/1927 Owen ..... E04G 21/1891 33/462
1,825,759 A * 10/1931 Smith ..... G01B 3/566 33/462
2,023,539 A 10/1933 Packard
2,212,331 A 8/1939 Tracy
2,744,332 A * 5/1956 Day ..... E04G 21/1891 33/416
2,770,271 A * 11/1956 Kane ..... E04G 21/1891 269/203
3,183,596 A * 5/1965 Shaw ..... E04G 21/1891 33/481
3,373,496 A * 3/1968 Nelson ..... E04G 21/1891 33/423
4,071,061 A * 1/1978 Schneider ..... B27M 3/0073 100/913
4,462,166 A 7/1984 Furlong
4,598,482 A 7/1986 Castleton
4,683,633 A 8/1987 Loris
5,384,967 A 1/1995 Helmuth
5,440,977 A 8/1995 Poutanen
5,669,149 A * 9/1997 Meitzler ..... G01B 3/56 33/417
5,758,428 A 6/1998 Kotlinski
6,293,028 B1 9/2001 Sylvia
6,374,504 B1 4/2002 Graham
6,694,633 B1 2/2004 Nyquist
6,725,556 B1 4/2004 Graham
7,165,333 B1 1/2007 Abdulkader
(Continued)

*Primary Examiner* — Christopher Fulton
(74) *Attorney, Agent, or Firm* — Dale J. Ream

(57) ABSTRACT

A rafter measuring template includes a length adjustable primary arm, the distance between opposed ends being user-adjustable to indicate a rafter length. A ridge assembly is coupled to the primary arm configured to clamp onto a ridge board and determine potential rafter angle. The ridge assembly includes a clamp portion selectively attachable to the ridge board and securing the primary arm and an angle measurement portion coupled to the clamp portion and pivotal in an up/down manner, the measurement portion having indicia indicative of the angle of the primary arm relative to the ridge board. A wall plate engagement member having a wall plate is coupled to the primary arm defining an upstanding channel having a plurality of spaced apart selectable notches indicative of predetermined rafter widths. A plate engagement flange is capable of nesting flush against the wall plate such that the engagement flange determines a plate notch configuration.

9 Claims, 8 Drawing Sheets

(56) References Cited

U.S. PATENT DOCUMENTS

| | | | | |
|---|---|---|---|---|
| 9,021,713 | B1 * | 5/2015 | Pierson | G01B 3/563 33/462 |
| 9,120,241 | B2 * | 9/2015 | Holladay | B27B 9/04 |
| 2005/0115091 | A1 * | 6/2005 | Harris | B43L 7/10 33/461 |

* cited by examiner

TEMPLATE AND METHOD FOR MEASURING A RAFTER

BACKGROUND OF THE INVENTION

This invention relates generally to the process and devices for laying out and cutting rafters to be installed in a roof system of a residential or commercial building.

Traditionally, a carpenter or individual must make several trips up a ladder to determine the length of a span between the peak of a roof (as characterized by a ridge) and a wall plate such as may be at the top of an upstanding side wall of the building. This length measurement may be done by using a tape measure pulled between two people—one at the bottom and one at the top. And, even before the length can be determined, the angle of the future rafter must be estimated according to what width of lumber will be used. This angle measurement and the length measurement may be written on a paper, the palm of a worker's hand, or the like. Then, once the workers return to the ground, a piece of lumber may be cut to length and then lifted into position. Once the length and position of the rafter is confirmed, a notch to fit the wall plate may still need to be cut.

The complexity, inefficiency, potential for error, and the requirement to involve at least two workers makes it desirable to have a template for measuring the length, angle, and cuts that are needed to form the perfect rafter and to be done by a single worker. In other words, there needs to be a rafter measuring template that is useful by a Do-it-Yourself worker without an abundance of experience, skill, or helpers.

The rafter measuring template and its method of use according to the present invention provides a solution to each of the issues described above that otherwise make it difficult or overwhelming to a person who wants to build a roof system of rafters on his own without other helpers and with minimal training.

SUMMARY OF THE INVENTION

A rafter measuring template according to the present invention includes a length adjustable primary arm having a first end and an opposed second end, the distance between the first and second ends being user-adjustable to indicate a rafter length. A ridge assembly is operatively coupled to the first end of the primary arm and configured to selectively clamp onto the ridge board and determine an angle of a rafter. The ridge assembly includes a clamp portion selectively nested atop the ridge board of the roof system and securing the primary arm and an angle measurement portion coupled to the clamp portion and pivotal in an up/down relationship therewith, the measurement portion having indicia indicative of the angle of the primary arm relative to the ridge board.

A wall plate engagement member includes a wall plate coupled to a second end of the primary arm defining an upstanding channel having a plurality of spaced apart selectable notches each indicative of predetermined rafter widths and having a plate engagement flange capable of nesting flush against the wall plate such that the engagement flange determines a plate notch configuration.

Therefore, a general object of this invention is to provide a rafter measurement template and method in which a single worker may determine rafter length and angle without repeatedly climbing ladders and making multiple measurements to be translated to rafters to be cut.

Another object of this invention is to provide a rafter measurement template and method, as aforesaid, that includes an elongate primary arm mountable to a ridge board at a peak of a roof system and to a wall plate of a structure and held in place while angle measurements are locked in.

Still another object of this invention is to provide a rafter measurement template and method, as aforesaid, in which the template may be removed from the peak, once all angles and length are locked in, and overlaid on a rafter board and clearly indicates the proper cuts to be made.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1A:
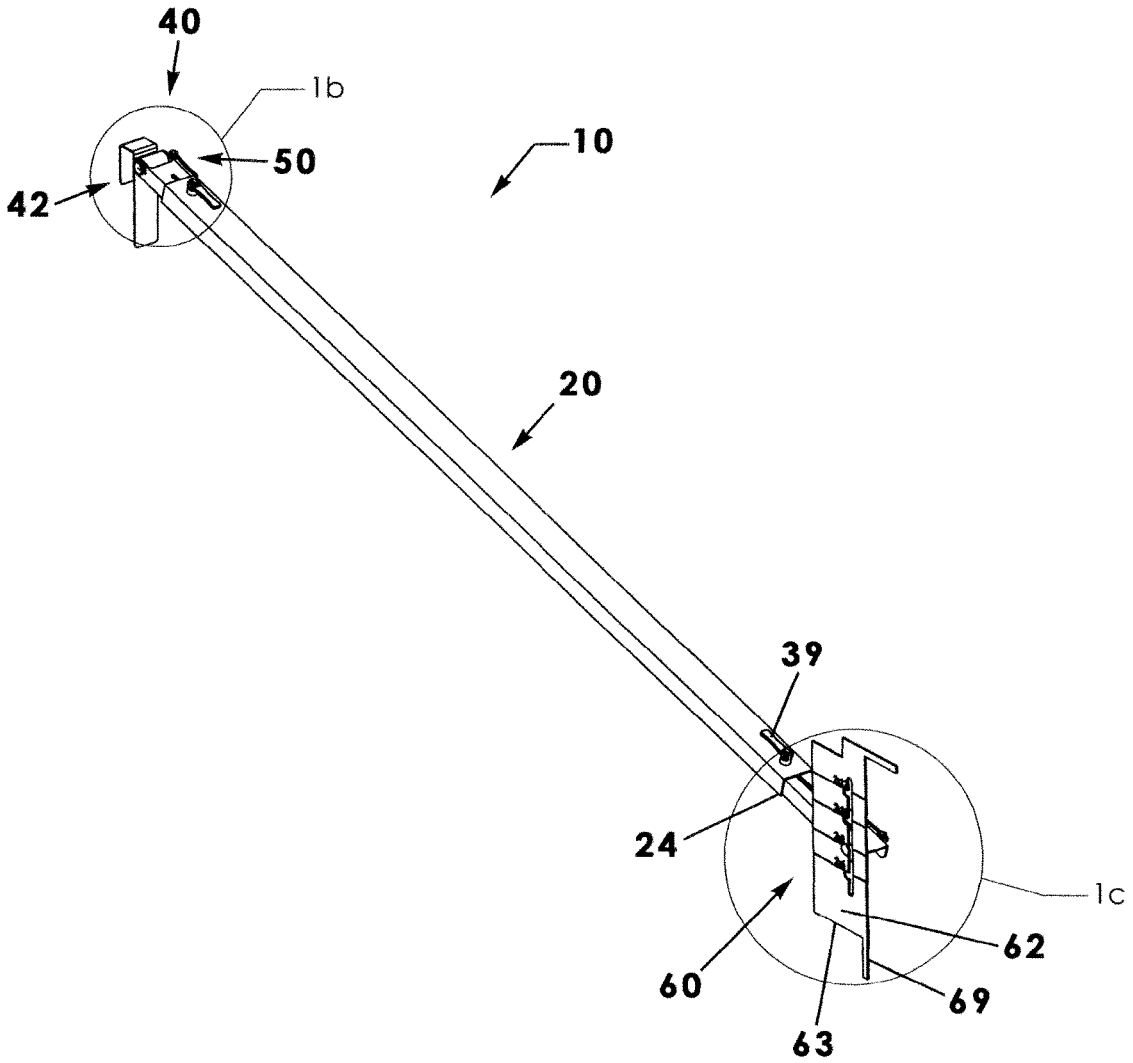
FIG. 1*a* is a perspective view of a rafter measurement template according to a preferred embodiment of the present invention.
Figure 1B:
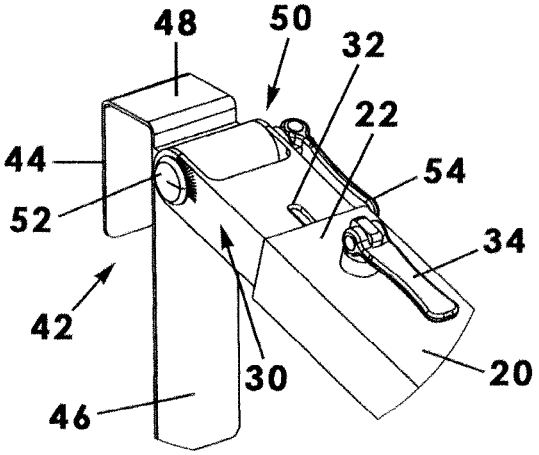
FIG. 1*b* is an isolated view on an enlarged scale taken from FIG. 1*a;*
Figure 1C:
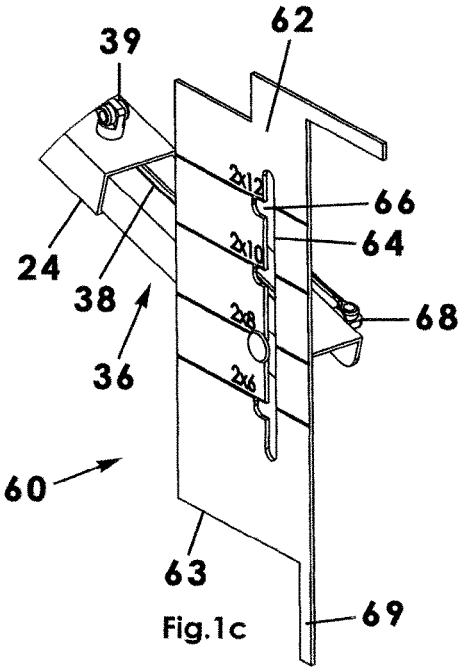
FIG. 1*c* is an isolated view on an enlarged scale taken from FIG. 1*a;*
Figure 2A:
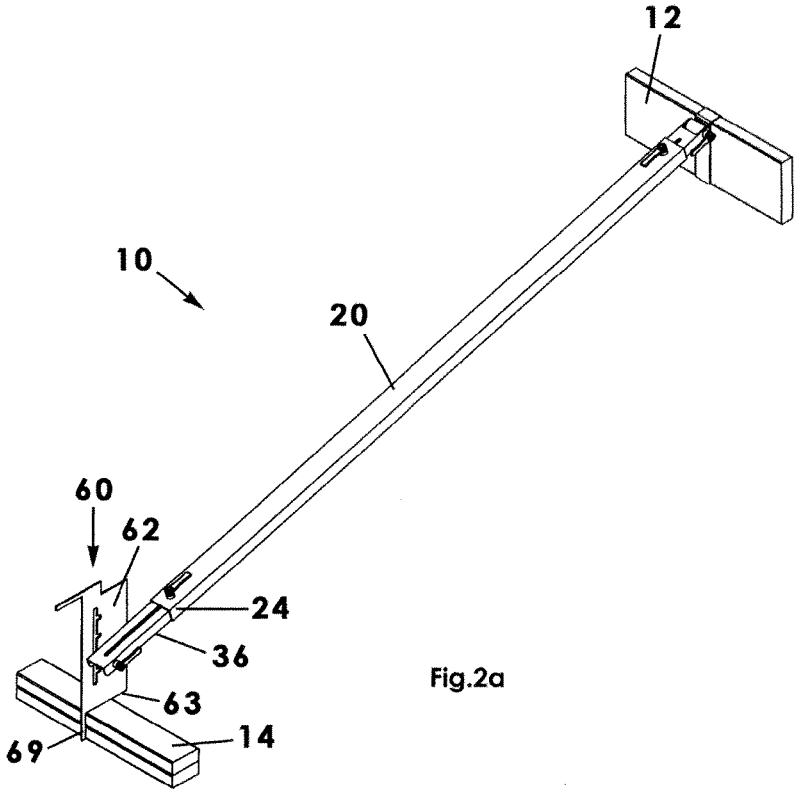
FIG. 2*a* is a perspective view of the rafter measurement template as in FIG. 1*a*, illustrated in use with a ridge board and wall plate of a roof system.
Figure 2B:
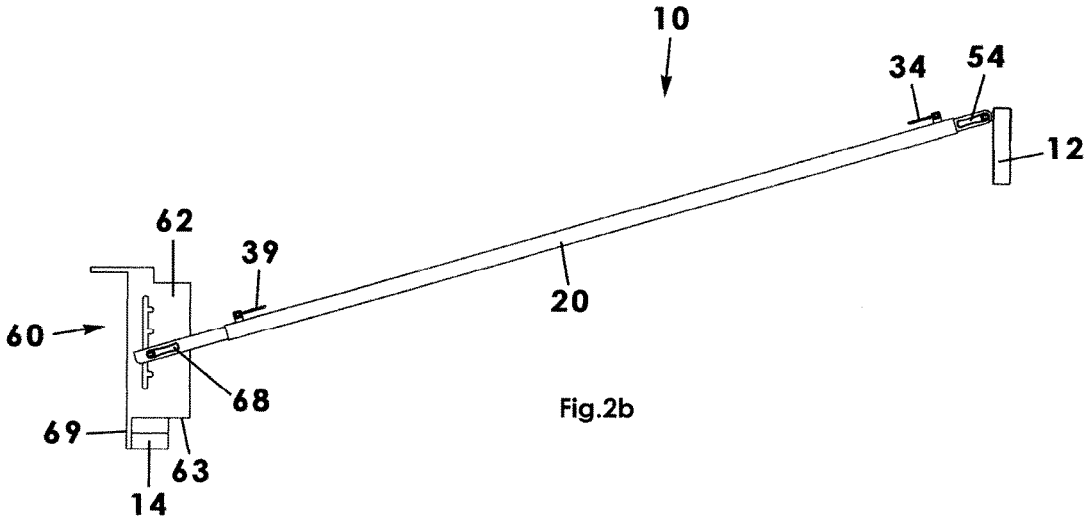
FIG. 2*b* is a side view of the rafter measurement template as in FIG. 2*a;*

A rafter measuring template and method for measuring and preparing a rafter according to a preferred embodiment of the present invention will now be described with reference to FIGS. 1*a* to 7*b* of the accompanying drawings. The rafter measuring template 10 includes a primary arm 20, a ridge assembly 40, and a wall plate engagement member 60.

The primary arm 20 is a length adjustable member having a first end 22 and a second end 24 opposed to the first end 22 and has a linear configuration that defines a length. The length adjustment is possible via a upper auxiliary portion 30 and a lower auxiliary portion 36 that are slidably movable between retracted and deployed configurations at first 22 and second 24 ends of the primary arm 20, respectively.

More particularly, the upper auxiliary portion 30 may include a plate slidably coupled to the first end 22 of the primary arm 20, such as the primary arm 20 defining a sleeve into which the upper auxiliary member 30 is selectively received or with similar structures like rails, and movable between a retracted configuration under or inside the primary arm 20 and an extended configuration extending outside of and away from the first end 22 of the primary arm 20. The upper auxiliary member 30 may define a slot 32 or channel while the primary arm 20 may include a pin 34 or other adjustment fastener (e.g. a quick lock fastener), the pin 34 and slot 32 configured for selectively locking the upper auxiliary member 30 at a user-selected configuration. In this manner, the primary arm 20 may be lengthened by a selected extension of the upper auxiliary member 30.

Similarly, the lower auxiliary member 36 may include a plate slidably coupled to the second end 24 of the primary arm 20, such as the primary arm 20 defining a sleeve into which the lower auxiliary member 36 is selectively received and an extended configuration extending outside of and away from the second end 24 of the primary arm 20. The lower auxiliary member 36 may define a slot 38 or channel while the primary arm 20 may include a pin 39 or other adjustment fastener, the pin 39 and slot 38 configured for selectively locking the lower auxiliary member 36 at a user-selected configuration. In this manner, the primary arm 20 may be lengthened by a selected extension of the lower auxiliary member 36.

The overall distance between opposed ends—including as operatively lengthened by extension of upper or lower auxiliary members (or both) represents the length of a desired rafter 16 and will be utilized to cut the rafter to length as will be described later.

The ridge assembly 40 is operatively coupled to the first end 22 of the primary arm and is configured to selectively clamp onto the ridge board and determine an angle of a rafter 16. More particularly, the ridge assembly 40 includes a clamp portion 42 having an inverted U-shaped configuration that selectively receives the ridge board of a roof system therein in a nested type configuration. More particularly, the clamp portion 42 may include a first side wall 44 and a second side wall 46 parallel and spaced apart from the first side wall 44, the side walls being connected together at upper ends, respectively, by a bridge 48. Together, the walls and bridge cooperate to form the U-shaped configuration described above. In an embodiment, the side walls may be constructed of a material so as to be biased toward one another at their free ends, respectively, so as to receive the ridge board 12 in a friction fit engagement. Further, an embodiment of the clamp portion 42 may include a size adjustment member that enables attachment to various dimensions of ridge board, such as a slidable length or telescopic bridge member 48. In other words, the clamp portion 42 is width adjustable.

The second side wall 46 of the clamp portion 42 may have an elongate configuration and be substantially longer than a length of the first side wall 44. The angular relationship of the second side wall 46 and the angle measurement portion 50 of the ridge assembly 40 defines a rafter end angle, as will be described further below in relation to placing the entire template atop a rafter and cutting selected portions thereof.

The angle measurement portion 50 of the ridge assembly 40 is releasably coupled to the clamp portion 42 (such as to the second side wall 46 as described above). More particularly, the angle measurement portion 50 may be pivotally coupled to the second side wall 46 in an up/down relationship such that an angle of a rafter extending between the ridge board 12 of a roof system and a wall plate 14 of a structure may be simulated and measured. The angle measurement portion 50 is coupled to the first end of the primary arm 20 such that the angle of the angle measurement portion 50 is changed by an up or down movement of the second end 24 (i.e. lower end) of the primary arm 20, the angle adjustment portion 50 acting in the manner of a fulcrum.

The angle measurement portion 50 may include an angle indicator 52 (FIG. 1*b*) having a plurality of scale indicia indicative of the angle of the primary arm in relation to connection to the second side wall 46 of the clamp portion 42 (and, thus, to the ridge board). A first locking device 54 is operatively coupled to the angle indicator 52 of the angle measurement portion 50 for selectively preserving a measured angle determination. It is understood that the first locking device 54 should be left in a loose relationship until the width selection of a future rafter has been set by use of the wall engagement member 60, as will be described below.

The wall plate engagement member 60 (FIG. 1*c*) is coupled to the second end 24 of the primary arm 20 (or, alternatively, to the lower auxiliary section 36) and includes a plate 62 having a thin, planar configuration. Preferably, the plate 62 is oriented in an upstanding, generally vertical position in use). The plate 62 defines an upward extending channel 64 having a plurality of spaced apart channel notches 66, each channel notch 66 being associated with indicia indicative of rafter widths. For instance, the notches 66 may indicate that the rafter 16 will be a 2×6, 2×8, 2×10, 2×12, or the like. The selected notch will have an effect on how a wall plate notch 18 will be determined and cut in a rafter 16 as will be described later. It also affects the angle of the primary arm 20 as measured by the angle measuring portion described above. A second locking device 68 is associated with the wall plate engagement member 60 for preserving a selected channel notch 66 and, thus, the dimensions of a wall plate notch 18 to be cut in a rafter 16.

Figure 3A:
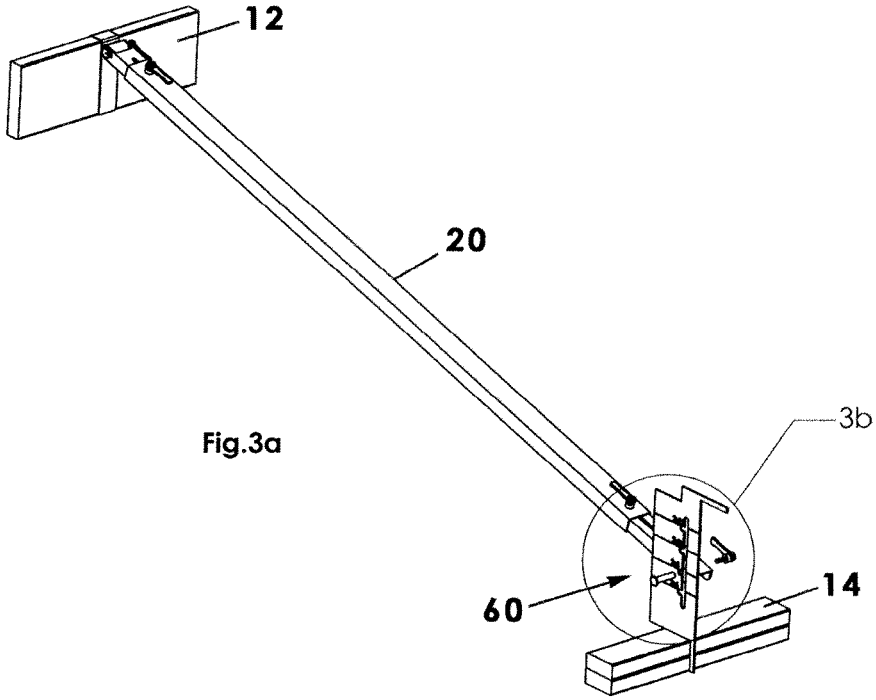
FIG. 3*a* is a perspective view from another angle of the rafter measurement template as in FIG. 2*a;*
Figure 3B:
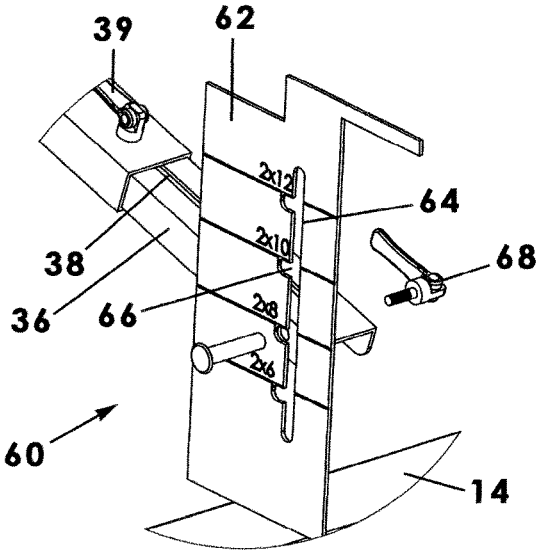
FIG. 3*b* is an isolated view on an enlarged scale taken from FIG. 3*a;*
Figure 4A:
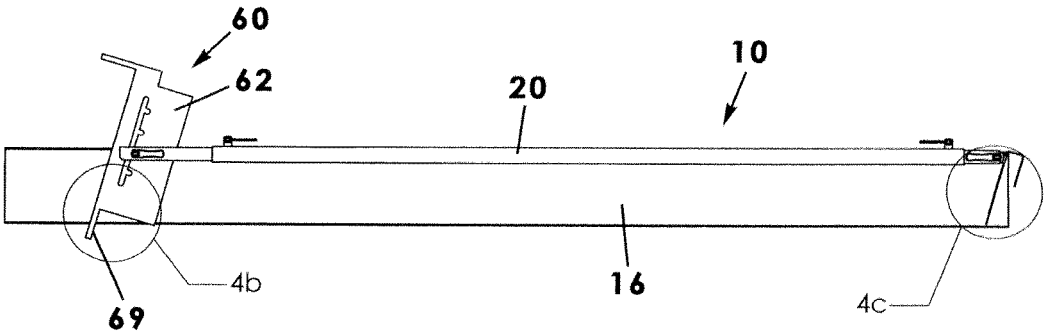
FIG. 4*a* is a side view of the rafter measurement template in use positioned on a rafter so as to indicate where cuts are to made on the rafter.
Figure 4B:
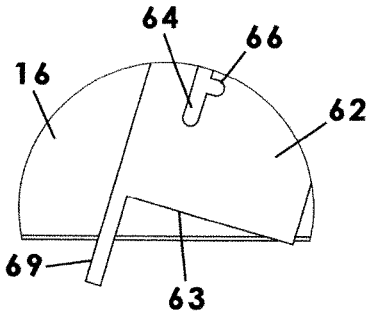
FIG. 4*b* is an isolated view on an enlarged scale taken from FIG. 4*a;*
Figure 4C:
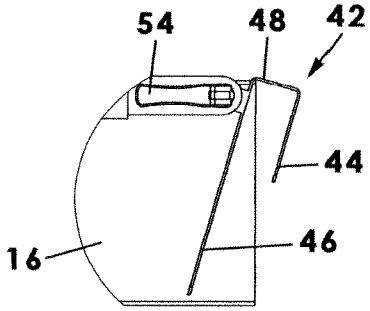
FIG. 4*c* is an isolated view on an enlarged scale taken from FIG. 4*a;*
Figure 4D:
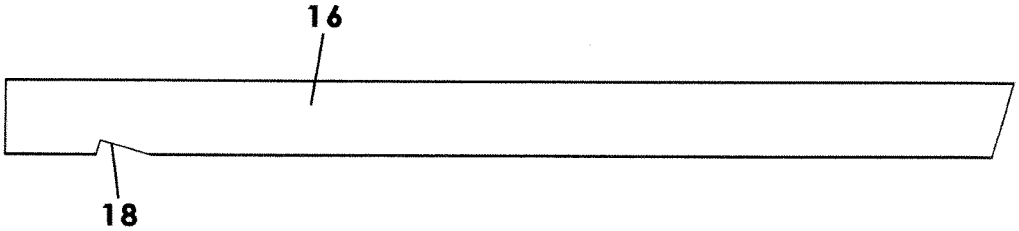
FIG. 4*d* is a side view of the rafter removed from the rafter measurement template after the indicated cuts have been made.
Figure 5A:
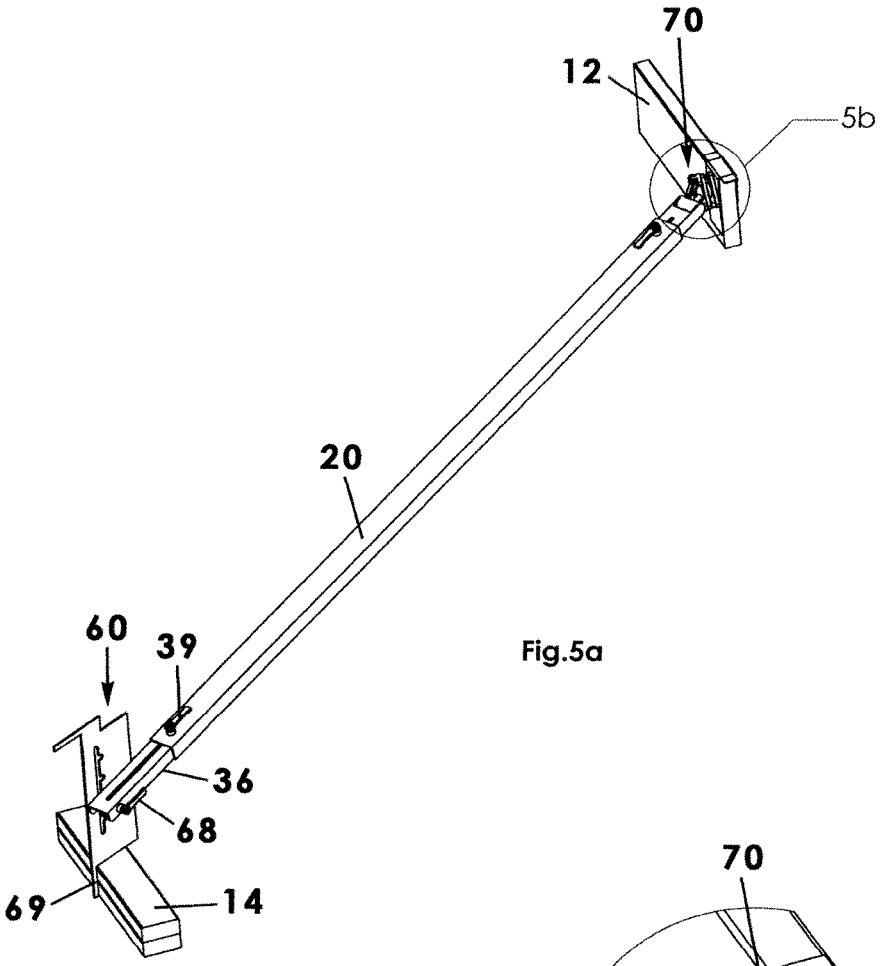
FIG. 5*a* is a perspective view of the rafter measurement template having a ball joint assembly intermediate the angle adjustment portion and the clamp portion of the ridge assembly.
Figure 5B:
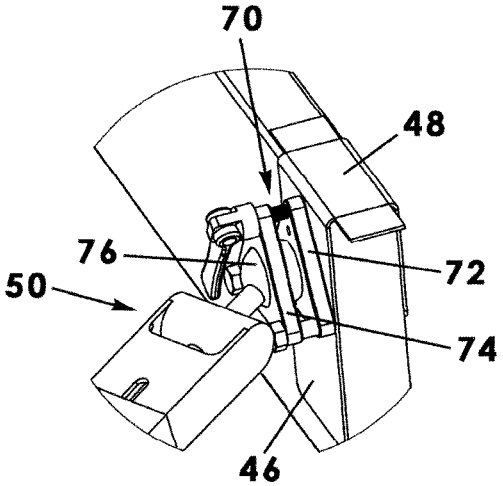
FIG. 5*b* is an isolated view on an enlarged scale taken from FIG. 5*a;*
Figure 6A:
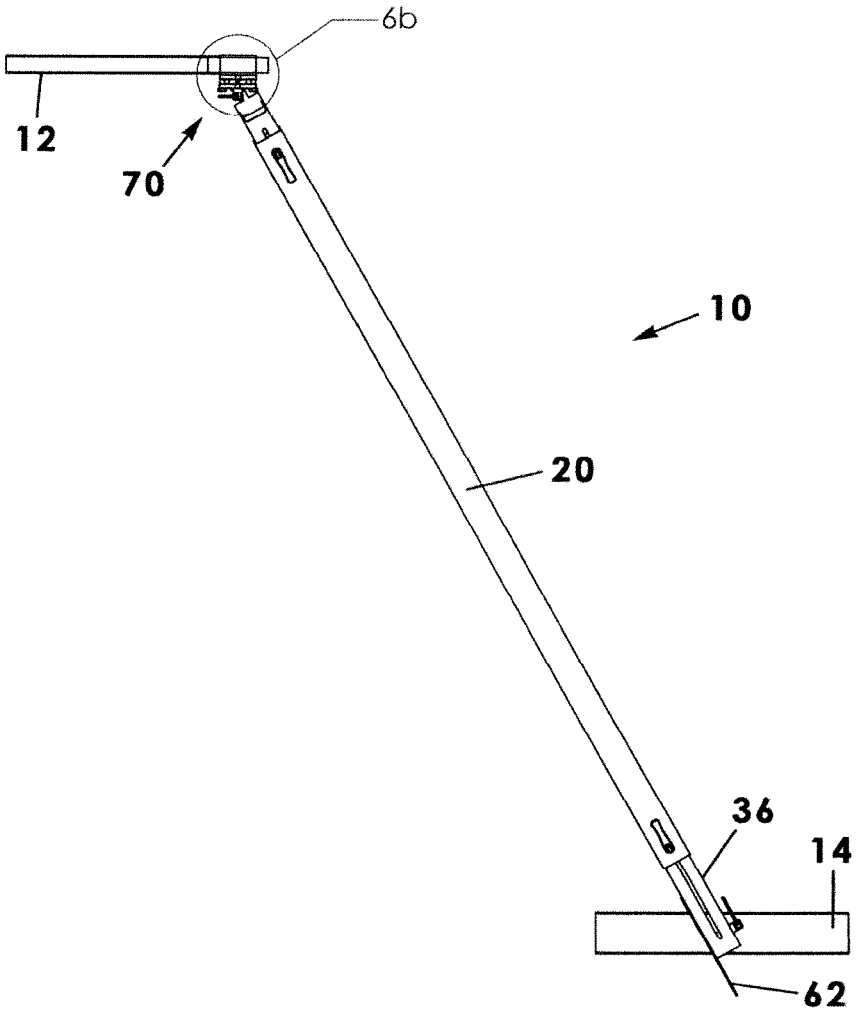
FIG. 6*a* is a top view of the rafter measurement template as in FIG. 5*a;*
Figure 6B:
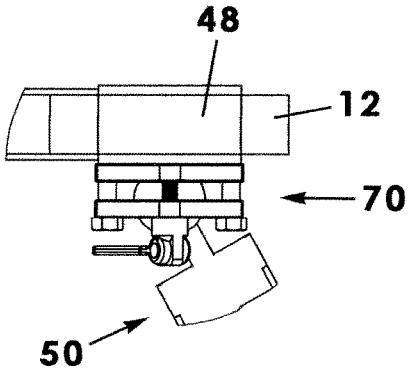
FIG. 6*b* is an isolated view on an enlarged scale taken from FIG. 6*a;*
Figure 7A:
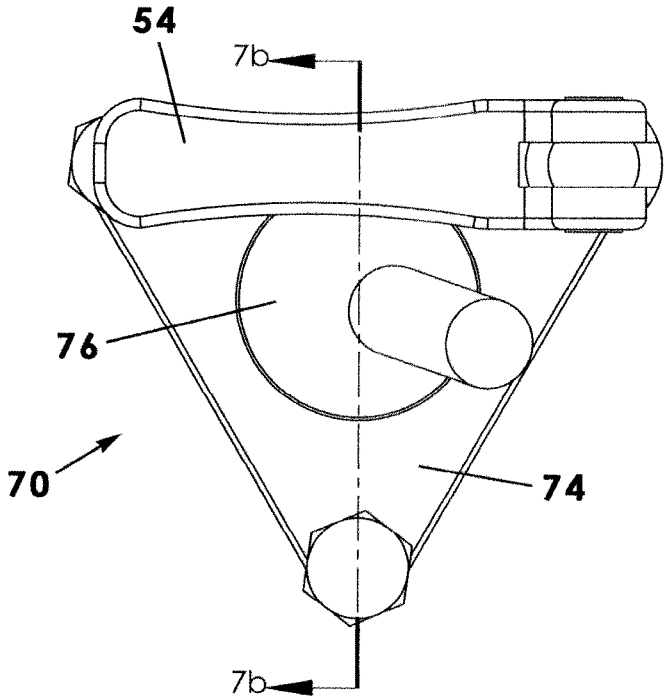
FIG. 7*a* is a front view of the ball joint assembly removed from the template as in FIG. 5*a*.
Figure 7B:
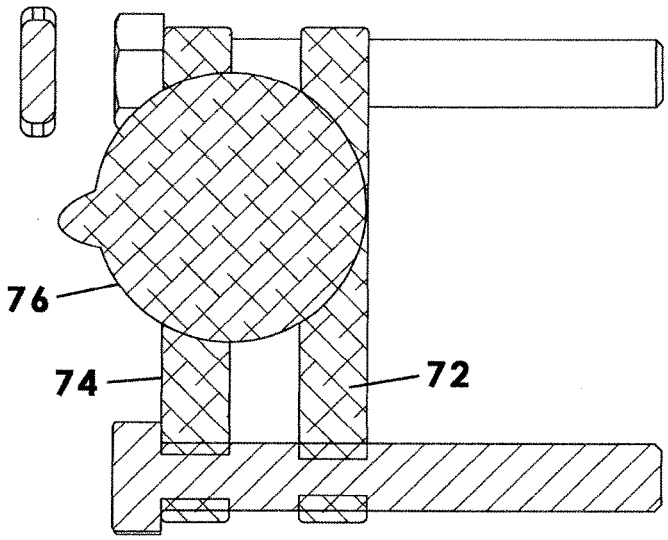
FIG. 7*b* is a sectional view taken along line 7*b*-7*b* of FIG. 7*a.*

The wall plate engagement member 60 includes a plate engagement flange 69 extending downwardly (or away) from a lower edge 63 of the plate 62 (FIG. 1*c*) and configured so that the lower edge 63 and flange 69 may nest flush to a top and side of the wall plate 14 of a roof system (FIG. 3*a*). When the template 10 is later laid atop a rafter 16, the lower edge 63 and engagement flange 69 will, together, define the proper angle and configuration of a wall plate notch 18 to be cut from the rafter 16 (FIGS. 4*b* and 4*d*). It is important to note that the wall plate notch 18 of a rafter 16 can only be determined properly by the combination of the selected channel notch 66 in relation to the predetermined "template" dimensions of the planar plate 62 of the wall plate engagement member 60.

With further reference to how the primary arm 20 is adjustable, the ridge assembly 40 may include a ball joint assembly 70 that operatively couples the angle measurement portion 50 to the clamp portion 42 in a manner that enables the primary arm 20 to swivel side to side as well as to pivot vertically. More particularly, the ball joint assembly 70 includes a stationary plate 72 coupled to the second side wall 46 of the clamp portion 42. Further, the ball joint assembly 70 includes a clamping plate 74 displaced forwardly from the stationary plate 72. The ball joint assembly 70 includes a ball joint 76 operatively coupled to the clamping plate 74 and configured for 360 degree movement or revolution relate to the clamping plate 74. It is understood that the plate engagement flange 69 of the wall plate engagement member 60 determines an angular plate notch 18 configuration when the ball joint assembly 70 is swiveled left or right and the plate engagement flange 69 is nested about the wall plate 14.

In use, the primary arm 20 of the rafter measurement template 10 is positioned—making length adjustments as needed as described above—between the ridge board 12 at the peak of a roof system and the wall plate 14 of a structure. Specifically, the clamp portion 42 having an inverted U-shape configuration may be nested atop the ridge board 12 so as to support the primary arm 20. The upper and lower auxiliary portions should be left loose for adjustment until the length and angle is determined. Then, they may be locked in as described above. The wall plate engagement member 60 is positioned atop the wall plate 14 of the housing structure and the second locking device 68 is inserted into a respective channel notch 66 indicative of the size/width of rafter to be used. This selection will affect the angle of the primary arm 20 and may be set prior to locking in the length. The angle of the primary arm 20 is indicated on the angle indicator 52 of the angle measurement portion 50 of the ridge assembly 40. The angle of the angle measurement portion 50 relative to the clamp portion 42 (specifically, the second side wall 46 thereof) may be locked by actuating the first locking device 54.

With the rafter angle and plate notch configuration being locked in, the entire template 10 may be released and removed from the roof system and moved to the ground. The primary arm 20 may then be overlaid atop a board to be fashioned as a rafter 16 as shown in FIGS. 4*a* to 4*d*. As particularly shown in FIGS. 4*a* and 4*c*, the second side wall 46 of the clamp portion 42 defines a rafter end angle, i.e. the angle that needs to be cut from the end of the rafter 16 so that it will fit appropriately relative to the ridge board 12. Then, the lower edge 63 and engagement flange 69 of the wall plate engagement member 60 will show and define the plate notch 18 to be cut from the rafter 16. FIG. 4*d* shows the rafter 16 after the angles and notch have been cut and the rafter 16 is ready for installation.

It is understood that while certain forms of this invention have been illustrated and described, it is not limited thereto except insofar as such limitations are included in the following claims and allowable functional equivalents thereof.

The invention claimed is:

1. A rafter measuring template for measuring a rafter of a roof system having a ridge board at a peak thereof and a wall plate opposite the peak, comprising:

a length adjustable primary arm having a first end and an opposed second end, the distance between said first and second ends being user-adjustable to indicate a rafter length;

a ridge assembly operatively coupled to said first end of said primary arm and configured to selectively clamp onto the ridge board and determine an angle of a rafter, said ridge assembly including:

a clamp portion having an inverted U-shape configuration for selectively nesting atop the ridge board and capable of securing said primary arm extending away from the ridge board;

an angle measurement portion releasably coupled to said clamp portion and pivotal in an up/down relationship therewith when released, said angle measurement portion including an angle indicator having indicia indicative of the angle of the primary arm relative to the ridge board;

a wall plate engagement member coupled to said second end of said primary arm, said wall plate engagement member having a plate defining an upstanding channel having a plurality of spaced apart selectable channel notches associated with indicia indicative of predetermined rafter widths and having a plate engagement flange capable of nesting flush against the wall plate such that said engagement flange determines a plate notch configuration of a rafter;

wherein a respective channel notch selection affects the angle determined by said angle measurement portion;

a first locking device associated with said angle measurement portion for selectively preserving an indication of an angle determination;

a second locking device associated with said wall plate engagement member for selectively preserving a selected channel notch selection for determining a wall plate notch of a rafter;

wherein said ridge assembly includes a ball joint assembly operatively coupled said angle measurement portion to said clamp portion, said ball joint assembly configured to selectively move in both an up/down pivotal movement and a left/right swivel movement according to a corresponding movement of said primary arm.

2. The rafter measurement template as in claim 1, wherein said clamp portion and said angle measure portion, when said first locking device is actuated, define a rafter end angle to be cut at a later time.

3. The rafter measurement template as in claim 2, wherein:

said clamp portion includes a first side wall, a second side wall 46 parallel and displaced from said first side wall, and a bridge member connecting upper ends of said first and second side wall 46*s*, wherein said first side wall, said second side wall 46, and said bridge cooperate to form said U-shaped configuration;

said second side wall 46 having an elongate configuration the length of which is greater than a length of said first side wall; and said angle adjustment portion is pivotally coupled to said second side wall 46 and, together, defines said rafter end angle.

4. The rafter measurement template as in claim 3, wherein said clamp member includes an adjustment member for adjusting a distance between said first and second side wall 46 such that said clamp member is capable of nesting atop ridge boards of different widths.

5. The rafter measurement template as in claim 1, wherein said primary arm includes:

an upper auxiliary section movably coupled to said first end of said primary arm, said auxiliary upper section being movable between a retracted configuration not extending away from said first end of said primary arm and a deployed configured extending away from said first end of said primary arm;

a lower auxiliary section movably coupled to said second end of said primary arm, said auxiliary upper section being movable between a retracted configuration not extending away from said first end of said primary arm and a deployed configured extending away from said first end of said primary arm.

6. The rafter measurement template as in claim 5, wherein:

said upper auxiliary section includes an adjustment fastener operatively coupled to said primary arm and to said upper auxiliary section and configured to selectively hold said upper auxiliary section at a selected retracted or deployed configuration;

said lower auxiliary section includes an adjustment fastener operatively coupled to said primary arm and to said lower auxiliary section and configured to selectively hold said lower auxiliary section at a selected retracted or deployed configuration.

7. The rafter measurement template as in claim 1, wherein said clamp member is width adjustable such that said clamp member is capable of nesting atop ridge boards of different widths.

8. The rafter measurement template as in claim 1, wherein:

said ridge assembly includes a ball joint assembly operatively coupled said angle measurement portion to said clamp portion, said ball joint assembly being configured to selectively move in both an up/down pivotal movement and a left/right swivel movement according to a corresponding movement of said primary arm;

said engagement flange of said wall plate engagement member determines an angular plate notch configuration when said ball joint assembly is swiveled left or right when said plate flange is nested on the wall plate.

9. A rafter measurement template for measuring a rafter of a roof system having a ridge board at a peak thereof and a wall plate opposite the peak, comprising:

a length adjustable primary arm having a first end and an opposed second end, the distance between said first and second ends being user-adjustable to indicate a rafter length;

a ridge assembly operatively coupled to said first end of said primary arm and configured to selectively clamp onto the ridge board and determine an angle of a rafter, said ridge assembly including:

a clamp portion having an inverted U-shape configuration for selectively nesting atop the ridge board and capable of securing said primary arm extending away from the ridge board;

an angle measurement portion releasably coupled to said clamp portion and pivotal in an up/down relationship therewith when released, said angle measurement portion including an angle indicator having indicia indicative of the angle of the primary arm relative to the ridge board;

a wall plate engagement member coupled to said second end of said primary arm, said wall plate engagement member having a plate defining an upstanding channel having a plurality of spaced apart selectable channel notches associated with indicia indicative of predetermined rafter widths and having a plate engagement flange capable of nesting flush against the wall plate such that said engagement flange determines a plate notch configuration of a rafter;

wherein a respective channel notch selection affects the angle determined by said angle measurement portion;

a first locking device associated with said angle measurement portion for selectively preserving an indication of an angle determination;

a second locking device associated with said wall plate engagement member for selectively preserving a selected channel notch selection for determining a wall plate notch of a rafter;

wherein:

said ridge assembly includes a ball joint assembly operatively coupling said angle measurement portion to said clamp portion, said ball joint assembly having a ball joint configured to selectively move in both an up/down pivotal movement and a left/right swivel movement according to a corresponding movement of said primary arm;

said engagement flange of said wall plate engagement member determines an angular plate notch configuration when said ball joint assembly is swiveled left or right when said plate flange is nested on the wall plate;

said clamp member includes a first side wall, a second side wall 46 parallel and displaced from said first side wall, and a bridge member connecting upper ends of said first and second side wall 46*s*, wherein said first side wall, said second side wall 46, and said bridge cooperate to form said U-shaped configuration;

said second side wall 46 having an elongate configuration the length of which is greater than a length of said first side wall; and said angle adjustment portion is pivotally coupled to said second side wall 46 and, together, defines said rafter end angle;

said ball joint assembly including:

a stationary plate coupled to said second side wall 46 of said clamp portion;

a clamping plate displaced forwardly from said stationary plate;

wherein said ball joint is coupled to said clamping plate and configured for 360 degree movement relative thereto.

* * * * *